US005541569A

United States Patent [19]

Jang

[11] Patent Number: 5,541,569

[45] Date of Patent: Jul. 30, 1996

[54] SWITCH HAVING A CIRCUIT BREAKER

[76] Inventor: Huey J. Jang, 87 buh-tzyy lane, Taichung City, Taiwan

[21] Appl. No.: 395,957

[22] Filed: Feb. 28, 1995

[51] Int. Cl.[6] ..... H01H 71/16

[52] U.S. Cl. ..... 337/68; 337/59; 337/79; 337/91

[58] Field of Search ..... 337/59, 60, 56, 337/68, 79, 91; 200/61.19; 218/89, 117

[56] References Cited

U.S. PATENT DOCUMENTS

| | | | |
|---|---|---|---|
| 4,803,455 | 2/1989 | Kuczynski | 337/68 |
| 4,833,439 | 5/1989 | Bowden et al. | 337/91 |
| 4,868,535 | 9/1989 | Janniere et al. | 337/66 |
| 5,453,725 | 9/1995 | You et al. | 337/68 |

*Primary Examiner*—Lincoln Donovan
*Attorney, Agent, or Firm*—Pro-Techtor International

[57] ABSTRACT

A switch having a circuit breaker comprising a housing into which an electric current is permitted to enter via a first wire connecting piece before arriving at a neon lamp via a movable piece, a fixation piece, a press tip and a spring. The press tip and a conductive piece are caused by the press key to swing so as to make contact with the fire wire connecting piece and a second wire connecting piece for turning on the neon lamp. When the electric current becomes excessive, a position limiting connection point is caused by a curve piece of a dual metal piece to withdraw from a slot of an insulated board. The insulated board is provided with a neck capable of being restrained by a projection of a housing cover of the housing so as to cause the insulated board to move up to bring about an automatic interruption of the flow of the electric current.

1 Claim, 4 Drawing Sheets

SWITCH HAVING A CIRCUIT BREAKER

FIELD OF THE INVENTION

The present invention relates generally to an electric switch, and more particularly to an electric switch provided with a circuit breaker.

BACKGROUND OF THE INVENTION

The U.S. Pat. No. 5,262,748 discloses an electric switch comprising a slot located between the housing and the surface housing, which are joined together. Located pivotally over the slot is a press block which is provided at one end thereof with a linking piece. The slot is provided at the bottom thereof with three sets of wire connecting pieces. Two of the three sets of wire connecting pieces are provided respectively with a platinum connection point and contact spring piece having one end which extends to reach over another wire connecting piece and which is also provided with a platinum connection point capable of making contact with the platinum connection point of another wire connecting piece. The one end of the contact spring piece is connected with the lower end of the linking piece so as to link the press block with the contact spring piece.

When an electric current becomes excessive, the surface curvature of the contact spring piece is caused to change so as to interrupt dutomatically the flow of the electric current.

The prior art switch described above is defective in design in that the contact spring piece is susceptible to a deformation caused by the temperature fluctuation. In other words, the metal fatigue of the contact spring piece can result in the instability of temperature sensitivity of the contact spring piece, thereby undermining the precision with which the contact spring piece responds to the fluctuation of temperature. As a result, the automatic interruption of the flow of the electric current can be brought about erroneously.

SUMMARY OF THE INVENTION

It is therefore the primary objective of the present invention to provide an electric switch with a press key having at the bottom thereof a tip barrel. The tip barrel is provided therein with a press tip capable of being urged by a spring to move out of the tip barrel to press against a movable piece which is provided at one end thereof with a platinum connection point and is located by a fixation piece. Fastened to one end of the fixation piece is a dual metal piece provided with a position limiting connection point which is inserted into the slot of an insulated board to make contact with a wire connecting piece. The insulated board is provided with a press block having at the bottom thereof a conductive piece capable of swinging to make contact with another wire connecting piece. The current is allowed to enter via the wire connecting piece of the dual metal piece and to reach the movable piece via the fixation piece before arriving at a neon lamp located in the press key. The neon lamp is turn on and off by the press tip and the conductive piece, which can be caused to make contact with the two wire connecting piece. The dual metal piece is caused to deform by the electric current with precision so as to cause the position limiting connection point to withdraw from the slot of the insulated board, thereby resulting in an automatic interruption of the electric current when the current becomes excessive.

DETAILED DESCRIPTION OF THE INVENTION

Figure 1:
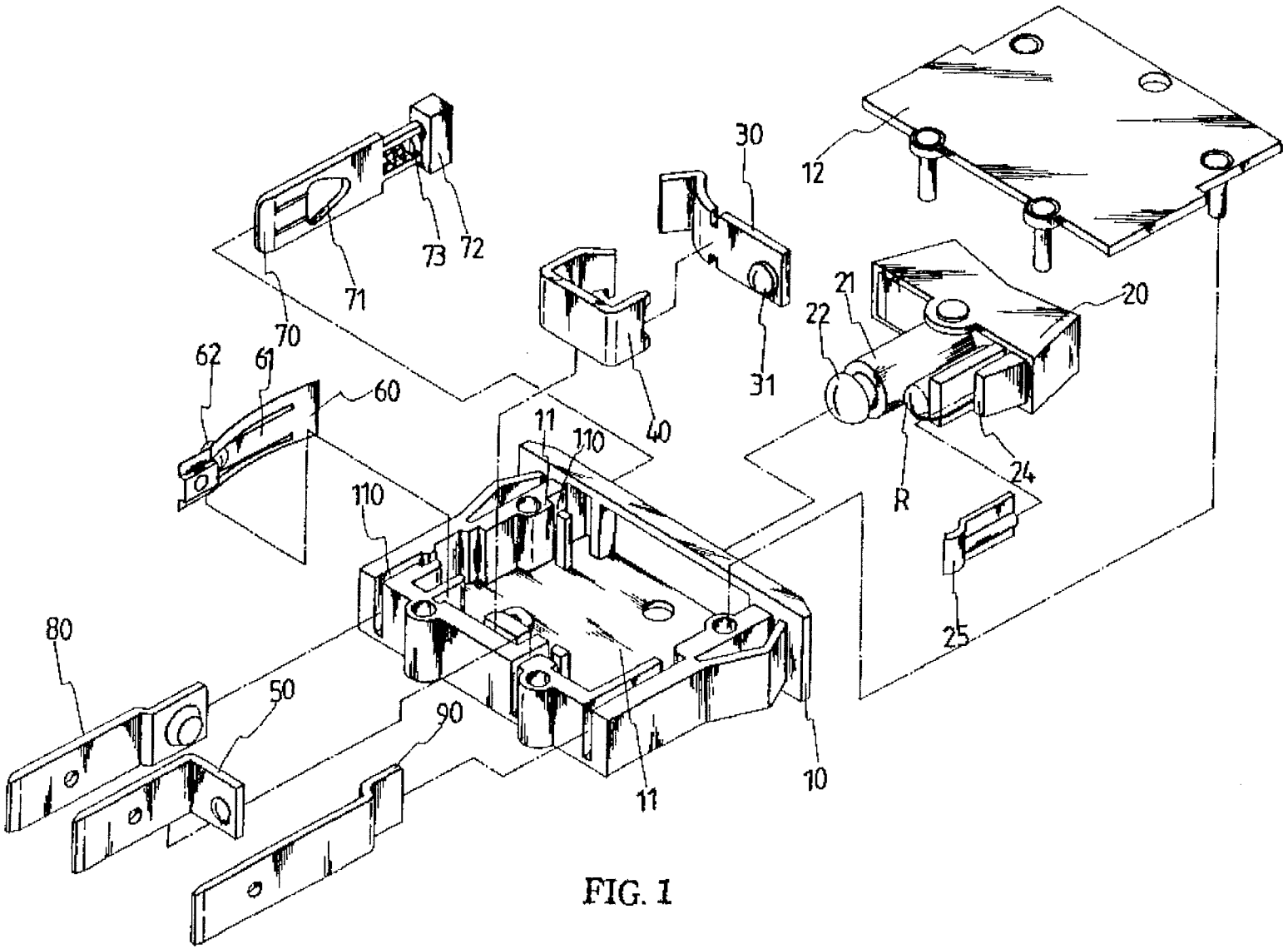
FIG. 1 shows an exploded view of the present invention.
Figure 2:
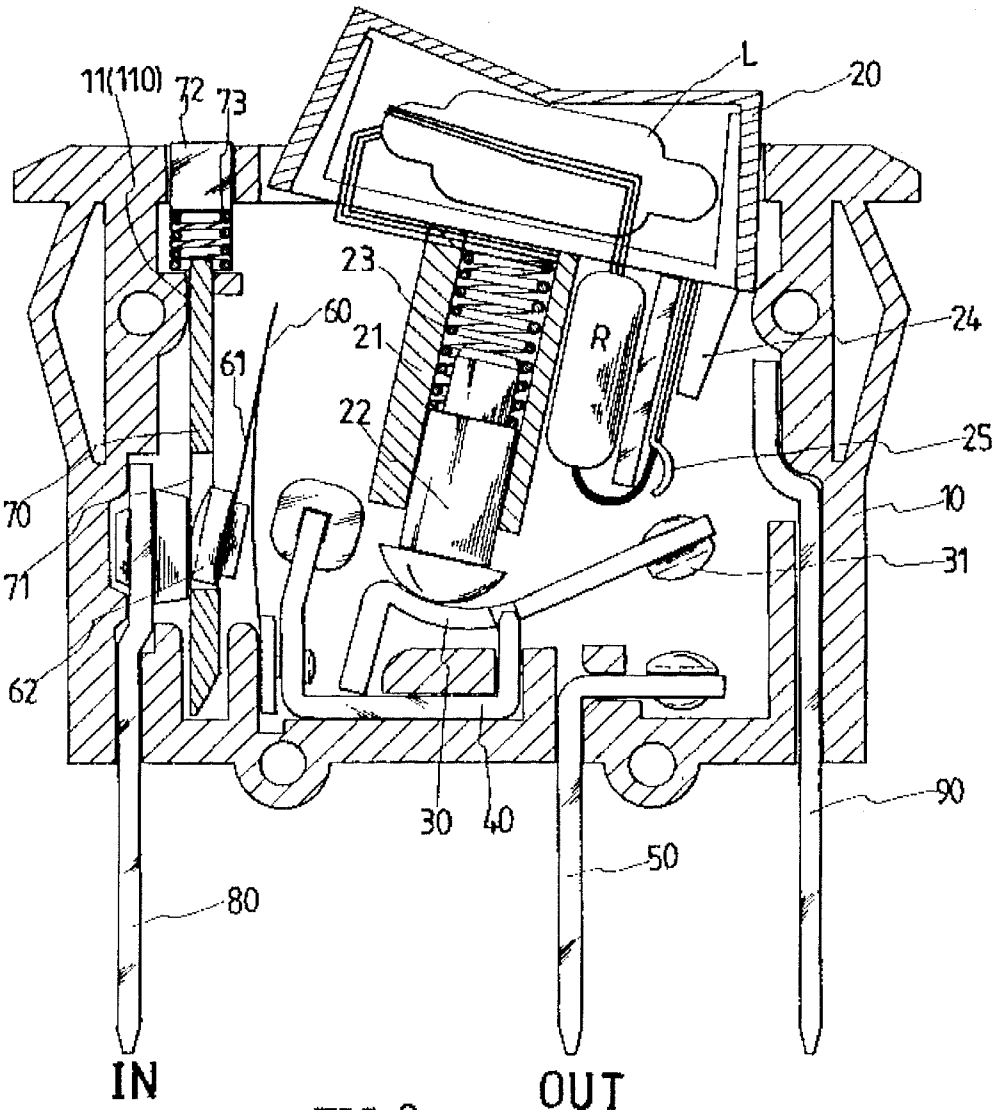
FIG. 2 shows a schematic view of the present invention in combination.

As shown in FIGS. 1 and 2, the present invention comprises a housing 10 in which a press key 20 is disposed pivotally. The press key 20 is provided therein with a neon lamp L, and tip barrel 21 having therein a metal press tip 22 which is urged by a spring 23 to move out of the tip barrel 21 to press against an L-shaped metal movable piece 30 which is provided at one end thereof with a platinum connection point 31 and which is fixed on a U-shaped metal fixation piece 40 such that the movable piece 30 can be caused to swivel. The movable piece 30 is pushed by the press tip 22 such that the platinum connection point 31 of the movable piece 30 is caused to make contact with a wire connecting piece 50.

The fixation piece 40 is provided at one end thereof with a dual metal piece 60 capable of deforming by a change in temperature. The dual metal piece 60 comprises a curve piece 61 provided with a position limiting connection point 62 which is located in a slot 71 of an insulated board 70 such that the position limiting connection point 62 is connected with another wire connecting piece 80. The insulated boared 70 is disposed in a slot 110 of a board seat 11 located in the housing 10 and is provided with a press block 72 having an upper portion which emerges from the housing 10. The press block 72 has a lower portion which is urged by an elastic piece 73 fastened to the board seat 11.

The press key 20 is provided at the bottom thereof with an insertion piece slot 24 in which a conductive piece 25 is disposed in such a manner that the conductive piece 25 is connected with a resistance R which is in turn connected with the neon lamp L, and that one end of the conductive piece 25 can be caused by the press key 20 to swing to make contact with another wire connecting piece 90.

Figure 3:
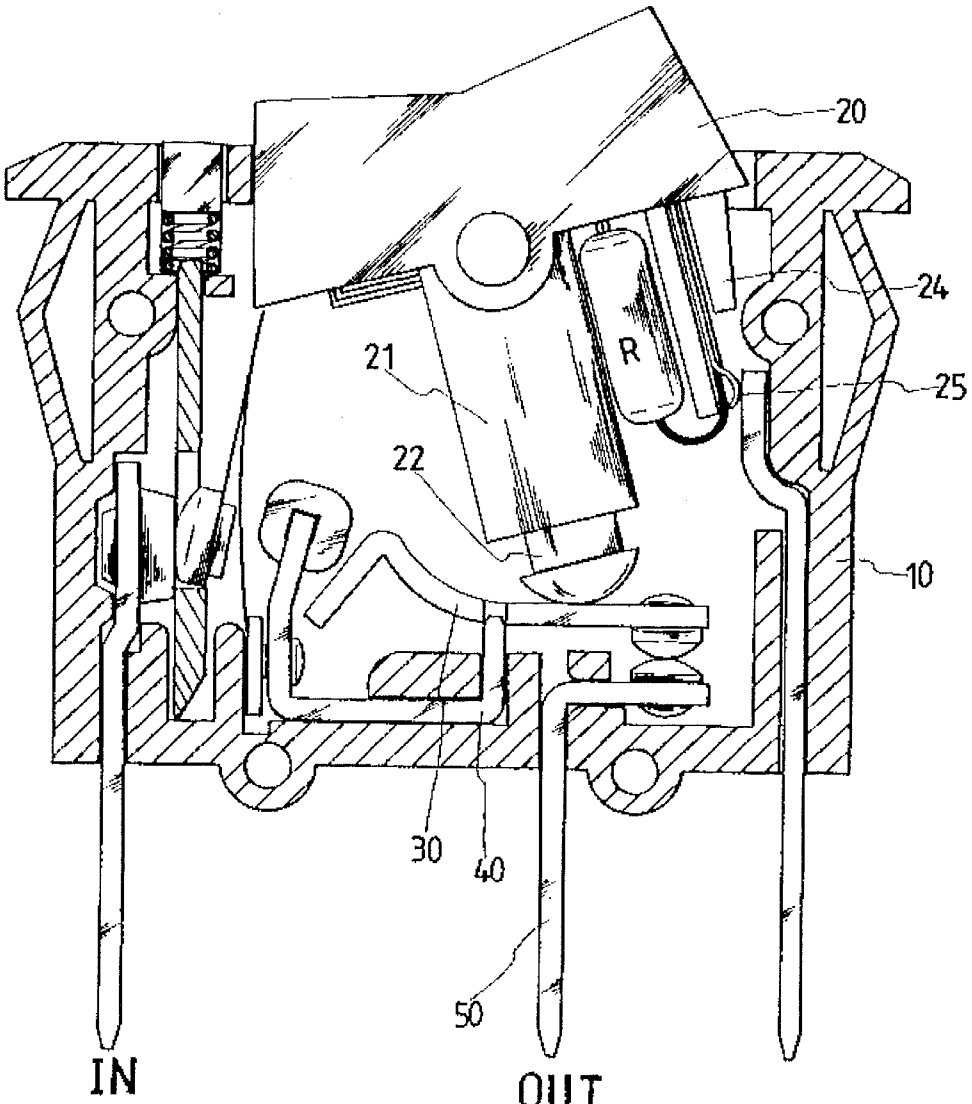
FIG. 3 shows a schematic view of the present invention in action.

An electric current is permitted to enter via the wire connecting piece 80 of the dual metal piece 60. The electric current is then allowed to arrive at the movable piece 30 via the fixation piece 40 before arriving at the neon lamp L via the press tip 22 and the spring 23. As shown in FIG. 3, the press tip 22 and the conductive piece 25 can be caused by the pressing of the press key 20 to swing so as to make contact with the two wire connecting pieces 50 and 90, thereby turning on the neon lamp.

Figure 4:
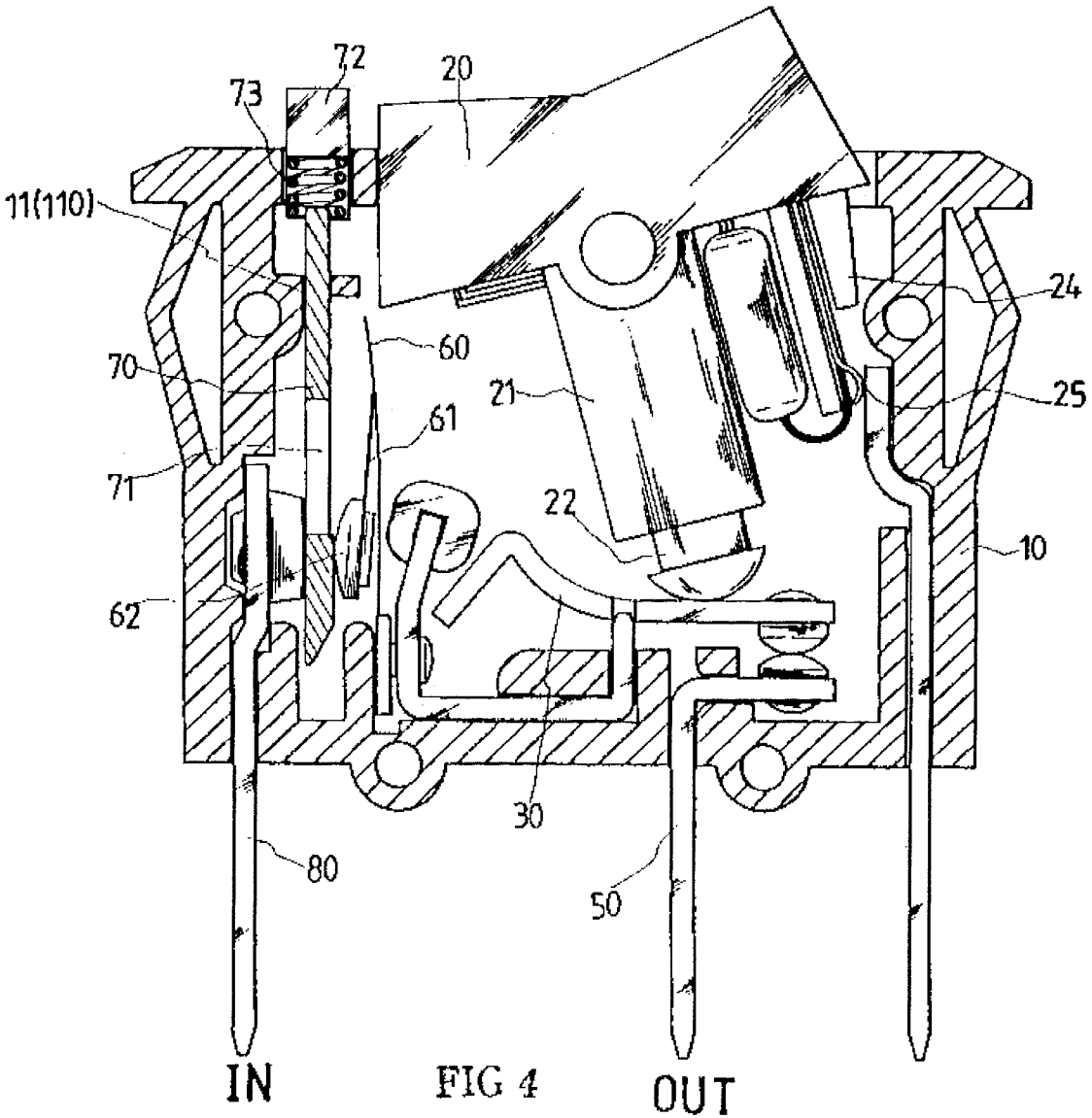
FIG. 4 shows another schematic view of the present invention in action.

As shown in FIG. 4, when the electric current becomes excessive, the position limiting connection point 62 is caused by the curve piece 61 of the dual metal piece 60 to withdraw from the slot 71 of the insulated board 70. The press block 72 of the insulated board 70 is urged by the elastic piece 73. In the meantime, a projection 120 of a housing cover 12 serves to restrain the movement of a neck 74 of the insulated board 70 so as to cause the insulated board 70 to move up to bring about an automatic interruption of the flow of the electric current. Such an interruption of the current flow is made readily apparent by the press block 72 of the insulated board 70, which is forced out of the housing 10 when the current interruption takes place.

What is claimed is:

1. A switch having a circuit breaker comprising:

a housing provided therein pivotally with a press key having therein a neon lamp and a tip barrel with a metal press tip which is urged by a spring so as to move out of said tip barrel to press against an L-shaped metal movable piece which is provided at one end thereof with a platinum connection point and which is fixed on a U-shaped metal fixation piece such that said movable piece can be caused to swivel, said movable piece capable of being pushed by said press tip such that said platinum connection point of said movable piece is caused to make contact with a first wire connecting piece;

wherein said fixation piece is provided at one end thereof with a dual metal piece capable of deforming with precision by a change in temperature, said dual metal piece comprising a curve piece provided with a position limiting connection point which is located in slot of an insulated board such that said position limiting connection point is connected with a wire connecting piece, said insulated board being disposed in a slot of a board seat located in said housing and provided with a press block having an upper portion emerging from said housing, said press block having a lower portion urged by an elastic piece fastened to said board seat;

wherein said press key is provided at a bottom thereof with an insertion piece slot in which a conductive piece is disposed in such a manner that the conductive piece is connected with a resistance which is in turn connected with said neon lamp, and that one end of said conductive piece can be caused by said press key to swing to make contact with a second wire connecting piece;

wherein an electric current is permitted to enter via said first wire connecting piece before arriving at said neon lamp via said movable piece, said fixation piece, said press tip and said spring, said press tip and said conductive piece capable of being caused by said press key to swing so as to make contact with said first wire connecting piece and said second wire connecting piece for turning on said neon lamp; and wherein said position limiting connection point is caused by said curve piece of said dual metal piece to withdraw from said slot of said insulated board when said electric current becomes excessive, said insulated board provided with a neck capable of being restrained by a projection of a housing cover of said housing so as to caused said insulated board to move up to bring about an automatic interruption of the flow of said electric current.

* * * * *